US008659497B2

(12) United States Patent
Tang et al.

(10) Patent No.: US 8,659,497 B2
(45) Date of Patent: Feb. 25, 2014

(54) ELECTRONIC DEVICE HOUSING ASSEMBLY AND MANUFACTURING METHOD THEREOF

(75) Inventors: Zi-Ming Tang, Shenzhen (CN); Fa-Guang Shi, Shenzhen (CN)

(73) Assignees: Fu Tai Hua Industry (Shenzhen) Co., Ltd., Shenzhen (CN); Hon Hai Precision Industry Co., Ltd., New Taipei (TW)

( * ) Notice: Subject to any disclaimer, the term of this patent is extended or adjusted under 35 U.S.C. 154(b) by 317 days.

(21) Appl. No.: 13/163,871

(22) Filed: Jun. 20, 2011

(65) Prior Publication Data

US 2012/0127040 A1 May 24, 2012

(30) Foreign Application Priority Data

Nov. 22, 2010 (CN) ..... 2010 1 0553222

(51) Int. Cl.
*H01Q 1/42* (2006.01)

(52) U.S. Cl.
USPC ..... 343/872; 343/702

(58) Field of Classification Search
USPC ..... 343/872, 873, 702
See application file for complete search history.

(56) References Cited

U.S. PATENT DOCUMENTS

| | | | | |
|---|---|---|---|---|
| 7,642,969 | B2 * | 1/2010 | Nam | 343/702 |
| 2004/0227679 | A1 * | 11/2004 | Lu | 343/702 |
| 2009/0002242 | A1 * | 1/2009 | Lasarov et al. | 343/702 |
| 2009/0213017 | A1 * | 8/2009 | Yang et al. | 343/702 |

* cited by examiner

*Primary Examiner* — Dieu H Duong
(74) *Attorney, Agent, or Firm* — Altis Law Group, Inc.

(57) ABSTRACT

A housing assembly includes an outer housing, a support member, an antenna cover, a foam member, and an adhesive member. The outer housing defines an antenna opening. The support member is positioned in the outer housing, and encloses the antenna opening. The support member defines a receiving portion for receiving an antenna module, and the receiving portion is aligned with the antenna opening. The antenna cover is positioned in the antenna opening. Both of the foam member and the adhesive member are positioned between the support member and the antenna cover, and the foam member surrounds the adhesive member. The adhesive member connects or fixes the antenna cover to the support member. A method of manufacturing the housing assembly is also provided.

19 Claims, 5 Drawing Sheets

ELECTRONIC DEVICE HOUSING ASSEMBLY AND MANUFACTURING METHOD THEREOF

BACKGROUND

1. Technical Field

The present disclosure relates generally to housing assemblies, more particularly, to a housing assembly for an electronic device having an antenna module.

2. Description of Related Art

Portable electronic devices, such as tablet computers and mobile phones with navigation and wireless internet access function, generally have an antenna module for receiving signals emitted by base station communication systems or satellites. The antenna module is positioned in an outer housing of the portable electronic device. The outer housing defines an antenna opening, and a plastic cover is positioned in the antenna opening for enclosing the antenna opening. The antenna module receives sent signals via the antenna opening. However, the plastic cover is generally fixed to the outer housing via screws, and thus it is difficult for an outer surface of the plastic cover to be coplanar with that of the outer housing. Therefore, the portable electronic device may have a poor aesthetic appearance. In addition, adjusting the screws wastes a lot of time.

Therefore, there is room for improvement within the art.

BRIEF DESCRIPTION OF THE DRAWINGS

The components in the drawings are not necessarily drawn to scale, the emphasis instead placed upon clearly illustrating the principles of the present disclosure. Moreover, in the drawings, like reference numerals designate corresponding parts throughout the several views.

DETAILED DESCRIPTION

Figure 1:
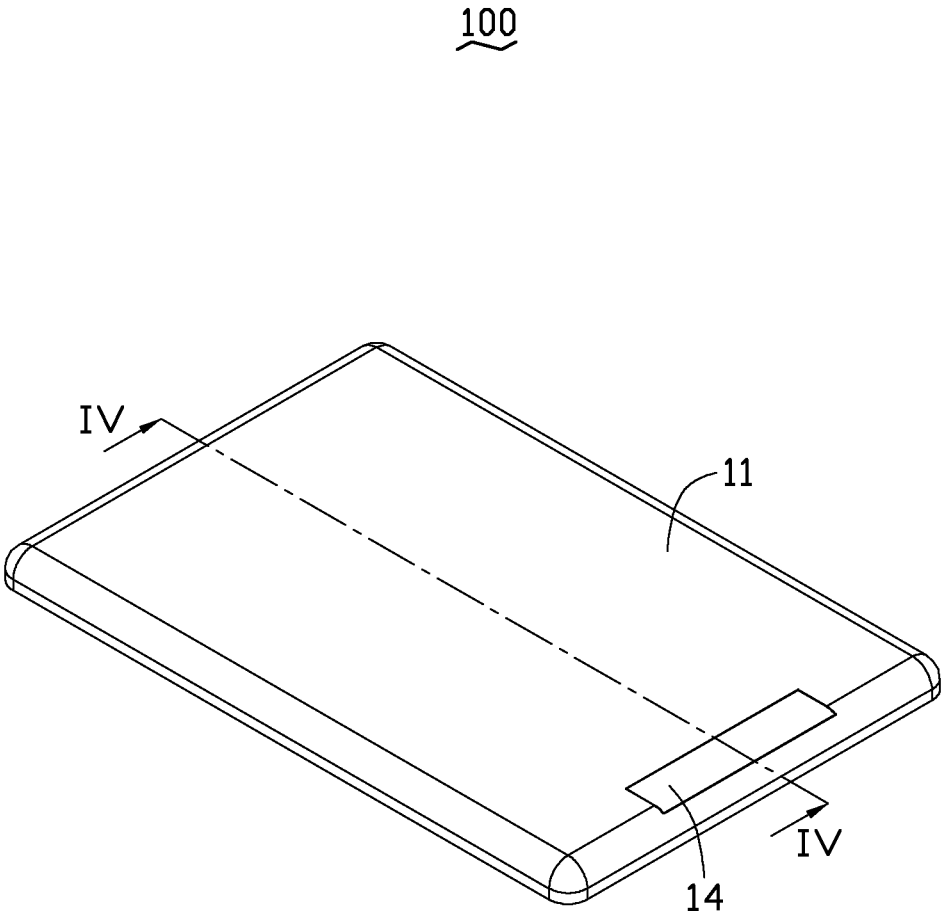
FIG. 1 is an isometric view of an embodiment of an electronic device.
Figure 2:
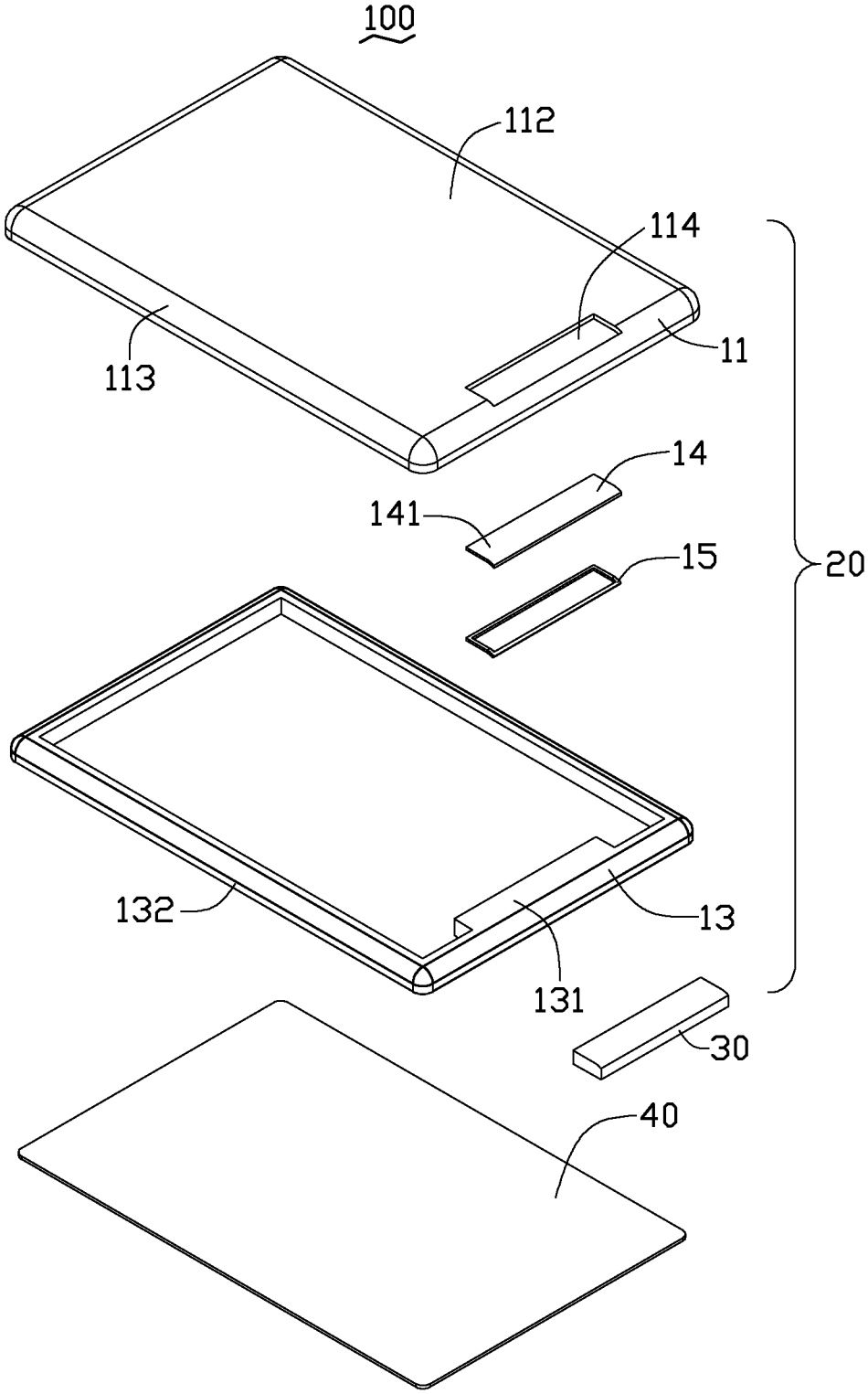
FIG. 2 an exploded, isometric view of the electronic device of FIG. 1.
Figure 3:
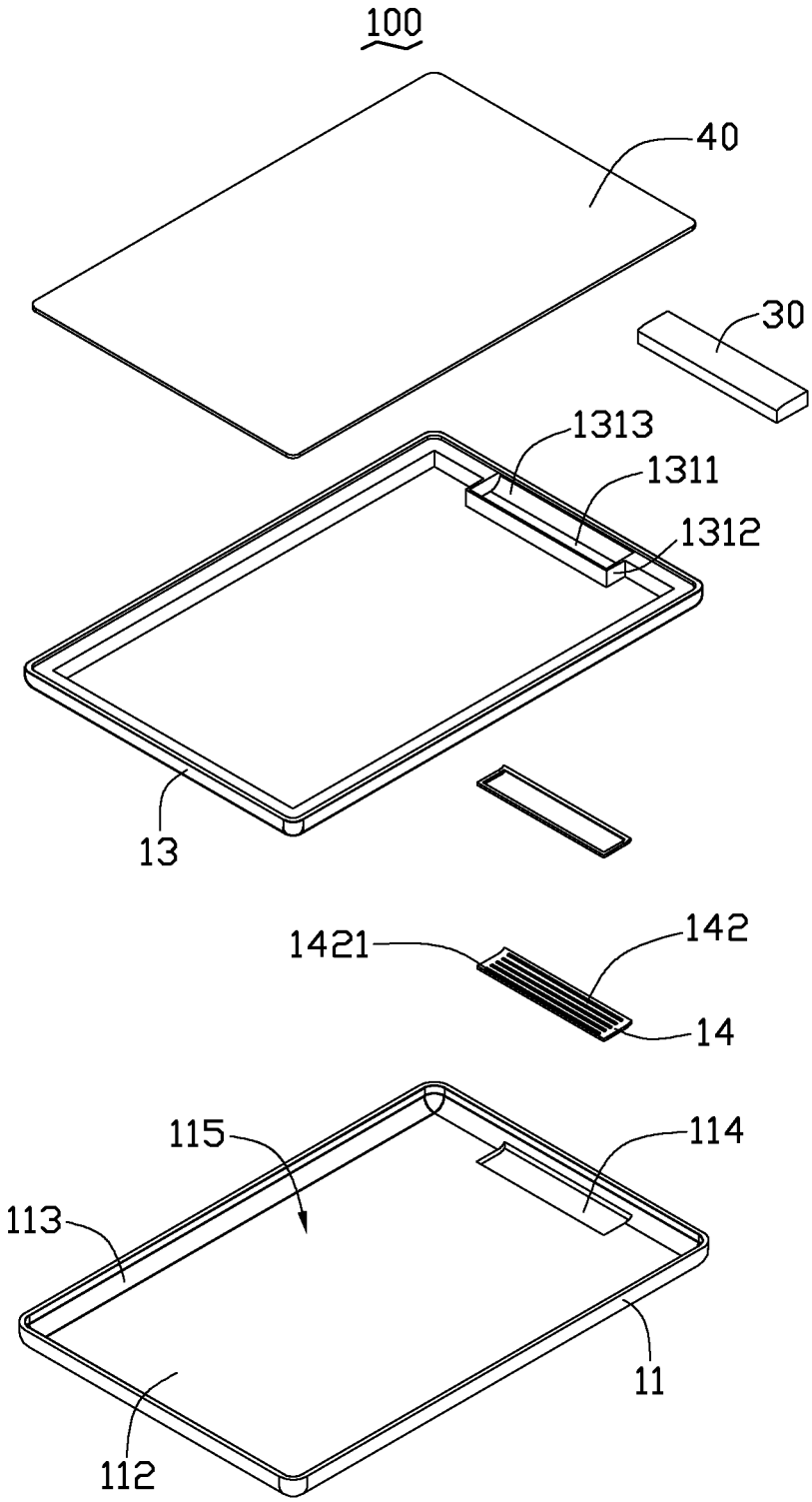
FIG. 3 is similar to FIG. 2, but viewed from another aspect.
Figure 4:
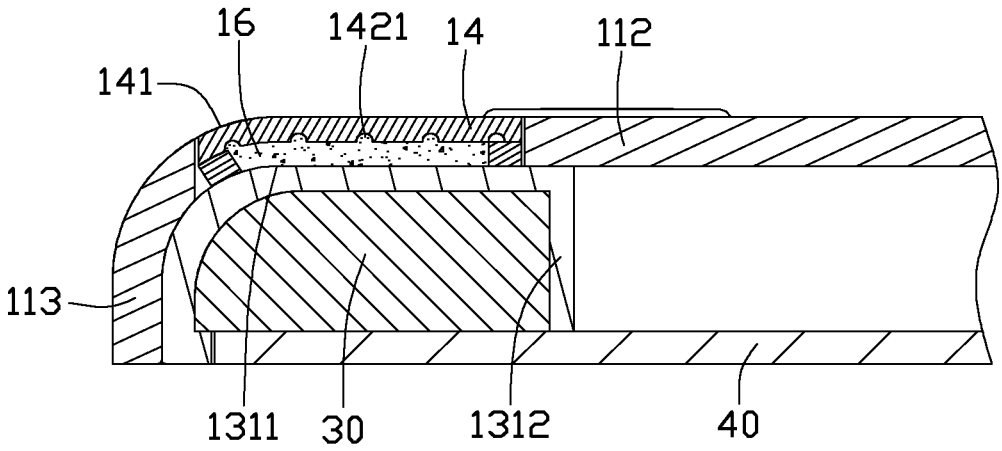
FIG. 4 is a partial cross-section of the electronic device of FIG. 1, taken along line IV-IV.

Referring to FIGS. 1 through 4, an embodiment of an electronic device 100 includes a housing assembly 20, an antenna module 30 received in the housing assembly 20, a touch panel 40, and a plurality of other electrical components (not shown).

The housing assembly 20 includes an outer housing 11, a support member 13, an antenna cover 14, a foam member 15, and an adhesive member 16. The support member 13 is positioned in the outer housing 11. The foam member 15 is positioned between the antenna cover 14 and the support member 13. The antenna cover 14 is adhered to the support member 13 via the adhesive member 16.

The outer housing 11 is a metal housing, and includes a bottom plate 112 and a side plate 113 extending from an edge of the bottom plate 112. The bottom plate 112 and the side plate 113 cooperatively define a receiving groove 115 to receive the antenna module 30, the touch panel 40, and the other electrical components. The outer housing 11 defines an antenna opening 114. In the illustrated embodiment, the antenna opening 114 is defined in a connecting portion of the bottom plate 112 and the side plate 113.

The support member 13 is a plastic member, and defines a receiving portion 131 to receive the antenna module 30. The support member 13 is fixed to the outer housing 11, with the receiving portion 131 enclosing the antenna opening 114. In the illustrated embodiment, the support member 13 is a rectangular frame, and an outer surface 132 of the support member 13 is tightly attached to the outer housing 11, and thereby enhancing the mechanical strength of the outer housing 11. The receiving portion 131 is formed on an end of the support member 13, and includes a bottom wall 1311 and a side wall 1312 extending from an edge of the bottom wall 1311. The bottom wall 1311 and the side wall 1312 cooperatively defines an assembly groove 1313 for receiving the antenna module 30. The bottom wall 1311 encloses the antenna opening 114, and the assembly groove 1313 of the receiving portion 131 is aligned with the antenna opening 114. The touch panel 40 is positioned on the support member 13.

The antenna cover 14 is made of plastic, and includes an outer surface 141 and a coupling surface 142 opposite to the outer surface 141. The antenna cover 14 is tightly engaged in the antenna opening 114. The coupling surface 142 defines a plurality of connecting grooves 1421 for partially receiving the adhesive member 16. In the illustrated embodiment, the connecting grooves 1421 are parallel to each other.

The foam member 15 is a rectangular ring and deformable, and is positioned between the antenna cover 14 and the support member 13. The adhesive member 16 can be epoxy adhesives, such as acrylic resins, phenolic resins or polyurethane resin. The adhesive member 16 is received inside the foam member 15, and sandwiched between the antenna cover 14 and the support member 13. In assembly of the antenna cover 14 to the outer housing 11, the foam member 15 can be deformed by pressing the antenna cover 14, and thus a thickness of the adhesive member 16 thereby also changes. Therefore, a height of the antenna cover 14 relative to the outer housing 11 can be adjusted, until the outer surface 141 of the plastic cover 14 is coplanar with that of the outer housing 11. Therefore, the portable electronic device 100 can have an excellent appearance.

Figure 5:
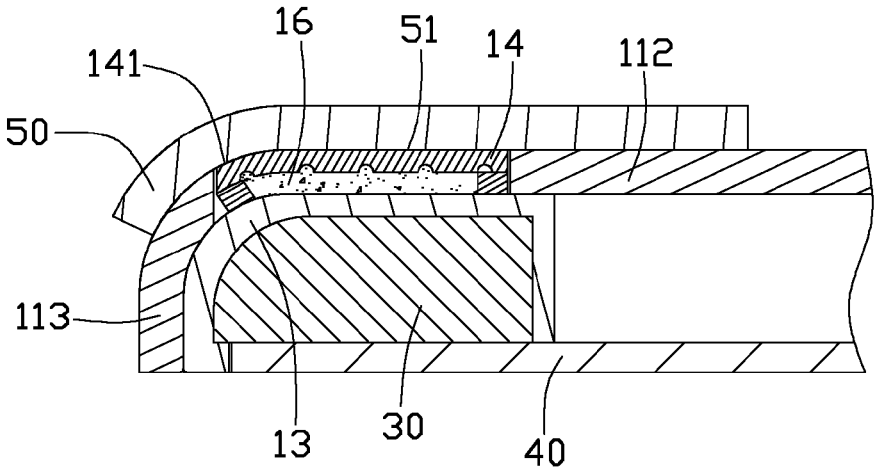
FIG. 5 is similar to FIG. 4, but showing the electronic device being pressed by a pressing member.

Referring to FIG. 5, one embodiment of a manufacturing method for the housing assembly 20 is described as follows. First, the outer housing 11 defining an antenna opening 114, the support member 13 with the receiving portion 131, and the antenna cover 14 are provided. Second, the support member 13 is positioned in the outer housing 11, and encloses the antenna opening 114. Third, the foam member 15 is positioned in the antenna opening 114, and attaches to the support member 13. Fourth, the adhesive member 16 is positioned in the antenna opening 114, and the foam member 15 surrounds the adhesive member 16. Fifth, the antenna cover 14 is assembled in the antenna opening 114, and attached to the adhesive member 16 and the foam member 15. Finally, a pressing member 50 having a pressing surface 51 is provided, and the pressing surface 51 is attached to the outer surface 141 of the antenna cover 14 and the outer surface of the outer housing 11. The pressing member 50 is pressed by an external force, until the plastic antenna cover 14 reaches a predetermined position that the outer surface 141 of the plastic antenna cover 14 is coplanar with that of the outer housing 11. The plastic antenna cover 14 is kept in the predetermined position for a while via the pressing member 50, until the adhesive member 16 is solidified, thereby fixing the plastic antenna cover 14 to the support member 13. After that, the pressing member 50 is removed. It should be appreciated that, the pressing member 50 can be used repeatedly in the manufacturing of the housing assembly 20.

It is believed that the present embodiments and their advantages will be understood from the foregoing description, and it will be apparent that various changes may be made thereto without departing from the spirit and scope of the disclosure or sacrificing all of its material advantages.

What is claimed is:

1. A housing assembly, comprising:

an outer housing defining an antenna opening;

a support member positioned in the outer housing, and enclosing the antenna opening, wherein the support member defines a receiving portion for receiving an antenna module, and the receiving portion is aligned with the antenna opening;

an antenna cover positioned in the antenna opening;

wherein the housing assembly further comprises a foam member and an adhesive member, both of which are positioned between the support member and the antenna cover, and the foam member surrounds the adhesive member, and the adhesive member fixing the antenna cover to the support member.

2. The housing assembly of claim 1, wherein the foam member is a rectangular ring.

3. The housing assembly of claim 1, wherein the foam member is deformable.

4. The housing assembly of claim 3, wherein the adhesive member is made of one of acrylic resins, phenolic resins or polyurethane resin.

5. The housing assembly of claim 1, wherein the support member is a plastic frame.

6. The housing assembly of claim 1, wherein the receiving portion comprises a bottom wall and a side wall extending from an edge of the bottom wall; the bottom wall and the side wall cooperatively define an assembly groove for receiving the antenna module.

7. The housing assembly of claim 1, wherein the antenna cover comprises an outer surface and a coupling surface opposite to the outer surface, and the coupling surface defines a plurality of connecting grooves for partially receiving the adhesive member.

8. The housing assembly of claim 7, wherein the connecting grooves are parallel to each other.

9. The housing assembly of claim 1, wherein the antenna cover is a plastic cover, and the outer housing is a metal housing.

10. An electronic device, comprising:

an antenna module;

a housing assembly, comprising:

an outer housing defining an antenna opening;

a support member positioned in the outer housing, and enclosing the antenna opening, wherein the support member defines a receiving portion aligned with the antenna opening, the antenna module is received in the receiving portion;

an antenna cover positioned in the antenna opening;

wherein the housing assembly further comprises a foam member and an adhesive member, both of which are positioned between the support member and the antenna cover, and the foam member surrounds the adhesive member, and the adhesive member connects the antenna cover to the support member.

11. The electronic device of claim 10, further comprising a touch panel positioned on the support member.

12. The electronic device of claim 10, wherein the foam member is a rectangular ring.

13. The electronic device of claim 10, wherein the foam member is deformable.

14. The electronic device of claim 13, wherein the adhesive member is made of one of acrylic resins, phenolic resins or polyurethane resin.

15. The electronic device of claim 10, wherein the support member is a plastic frame.

16. The electronic device of claim 10, wherein the receiving portion comprises a bottom wall and a side wall extending from an edge of the bottom wall; the bottom wall and the side wall cooperatively defines an assembly groove for receiving the antenna module.

17. The electronic device of claim 10, wherein the antenna cover comprises an outer surface and a coupling surface opposite to the outer surface, and the coupling surface defines a plurality of connecting grooves for partially receiving the adhesive member.

18. The electronic device of claim 17, wherein the connecting grooves are parallel to each other.

19. The electronic device of claim 10, wherein the antenna cover is a plastic cover, and the outer housing is a metal housing.

* * * * *